US011574783B2

(12) United States Patent
Nilsson et al.

(10) Patent No.: US 11,574,783 B2
(45) Date of Patent: Feb. 7, 2023

(54) SPLITTER PLATE, ARC EXTINGUISHING CHAMBER AND SWITCHING DEVICE

(71) Applicant: ABB Schweiz AG, Baden (CH)

(72) Inventors: Alfred Nilsson, Sundbyberg (SE); Markus Angell, Västerås (SE); David Karlén, Västerås (SE); Gunnar Johansson, Västerås (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/295,295

(22) PCT Filed: Nov. 15, 2019

(86) PCT No.: PCT/EP2019/081513
§ 371 (c)(1),
(2) Date: May 19, 2021

(87) PCT Pub. No.: WO2020/109034
PCT Pub. Date: Jun. 4, 2020

(65) Prior Publication Data

US 2022/0130627 A1 Apr. 28, 2022

(30) Foreign Application Priority Data

Nov. 29, 2018 (EP) ..... 18209174

(51) Int. Cl.
*H01H 33/08* (2006.01)

(52) U.S. Cl.
CPC ..... *H01H 33/08* (2013.01)

(58) Field of Classification Search
CPC .. H01H 33/08; H01H 33/10; H01H 2033/085; H01H 1/20; H01H 9/362;
(Continued)

(56) References Cited

U.S. PATENT DOCUMENTS 3,043,938 A 7/1962 Daly
5,498,847 A * 3/1996 Bennett ..... H01H 9/34 218/15

(Continued)

FOREIGN PATENT DOCUMENTS

CN 102299031 A 12/2011
CN 205177755 U 4/2016

(Continued)

OTHER PUBLICATIONS

Chinese Office Action; Application No. 201980076202.5; dated Mar. 28, 2022; 10 Pages.

(Continued)

*Primary Examiner* — William A Bolton
(74) *Attorney, Agent, or Firm* — Whitmyer IP Group LLC

(57) ABSTRACT

A splitter plate for an arc extinguishing chamber in a switching device, the splitter plate including a base portion; a pair of arms extending from the base portion; a recess for a movable contact defined between the arms; and a slot in each arm; wherein the recess is arranged between the slots. An arc extinguishing chamber for a switching device is also provided. A switching device for breaking an electric current, the switching device including a plurality of splitter plates or an arc extinguishing chamber is also provided.

20 Claims, 4 Drawing Sheets

(58) Field of Classification Search
CPC .. H01H 9/36; H01H 2009/365; H01H 73/045; H01H 73/18
USPC .. 218/146, 15, 29, 34, 38, 46, 81, 147, 149, 218/151, 105; 200/10
See application file for complete search history.

(56) References Cited

U.S. PATENT DOCUMENTS

| | | | | |
|---|---|---|---|---|
| 5,583,328 | A | 12/1996 | Mitsuhashi et al. | |
| 7,186,941 | B2 * | 3/2007 | Yeon | H01H 9/346 218/15 |
| 7,285,742 | B2 * | 10/2007 | Kinzler | H01H 71/0207 335/201 |
| 8,829,380 | B2 * | 9/2014 | Haeberlin | H01H 9/345 218/34 |
| 2008/0135525 | A1 * | 6/2008 | Claeys | H01H 9/362 218/151 |
| 2009/0223934 | A1 * | 9/2009 | Tetik | H01H 9/362 218/151 |
| 2011/0259852 | A1 * | 10/2011 | Rival | H01H 9/342 218/150 |
| 2015/0090566 | A1 | 4/2015 | Mattlar et al. | |
| 2017/0301490 | A1 * | 10/2017 | Domejean | H01H 33/182 |

FOREIGN PATENT DOCUMENTS

| | | | |
|---|---|---|---|
| DE | 102017202370 | A1 | 8/2018 |
| EP | 2393093 | A1 | 12/2011 |
| EP | 3327742 | A1 | 5/2018 |
| GB | 856057 | A | 12/1960 |
| GB | 2018515 | A | 10/1979 |
| KR | 200393296 | Y1 | 8/2005 |

OTHER PUBLICATIONS

Chinese Search Report; Application No. 201980076202.5; dated Mar. 28, 2022; 4 Pages.
Extended European Search Report; Application No. 18209174.4; dated May 16, 2019; 1 Page.
International Preliminary Report on Patentability: Application No. PCT/EP2019/081513; dated Oct. 22, 2020; 6 Pages.
International Search Report and Written Opinion of the International Searching Authority; Application No. PCT/EP2019/081513; Completed: Jan. 8, 2020; dated Jan. 16, 2020; 13 Pages.
Chinese Office Action; Application No. 201980076202.5; dated Oct. 18, 2021; 9 Pages.
Chinese Rejection Decision and rejection form; Application No. 201980076202.5; dated Jun. 2, 2022; 11 Pages.

* cited by examiner

SPLITTER PLATE, ARC EXTINGUISHING CHAMBER AND SWITCHING DEVICE

TECHNICAL FIELD

The present disclosure generally relates to splitter plates. In particular, a splitter plate comprising a pair of arms and a slot in each arm, an arc extinguishing chamber for a switching device, which arc extinguishing chamber comprises a plurality of splitter plates, and a switching device for breaking an electric current, which switching device comprises a plurality of splitter plates, are provided.

BACKGROUND

Switching devices are used for making, conducting and interrupting an electric current, for example in order to switch on and switch off an electric load to and from a grid. Switching devices may comprise a stationary contact and a movable contact which are in mechanical and electrical contact during normal operation of the switching device. The movable contact may be separated from the stationary contact as part of a current breaking operation. The current breaking operation by the switching device may additionally comprise extinguishing a breaking arc between the movable contact and the stationary contact, and a decrease of the electric current to zero.

When breaking an electric current without any natural zero-crossings, it is necessary to force the electric current down to zero. One common practice is to create an electric voltage across a breaking point that is higher than the system voltage to thereby force the electric current to decrease to zero. In order to achieve such electric voltage across the breaking point, it may be desired to stretch the breaking arc over a relatively long distance since the long arc is easily split into several shorter arcs that further increase the arc voltage.

An arc may be elongated by separating the movable contact from the stationary contact. When the movable contact separates from the stationary contact, the arc must leave the contact points quickly in order to avoid erosion of contact materials. To this end, an arc extinguishing chamber comprising splitter plates may be provided. The splitter plates may comprise two arms and a passage for the movable contact defined between the arms.

An arrangement of the arms of the splitter plates to embrace the point where the arc is ignited from the movable contact is an effective method to get magnetic attraction, arc splitting and cooling of the breaking arc in a switching device. In order to maximize the efficiency of the splitter plates, it is desirable to arrange the splitter plates as close as possible to the point where the arc is ignited.

When the splitter plates are heated by arcs, the splitter plates are deformed and the arms have a tendency to bend outwards. During the following cooling, the splitter plates have a tendency to bend inwards. This may cause blocking of the passage for the movable contact and a consequential failure of the switching device. The inward bending of the arms is difficult to prevent. Since a rather high number of splitter plates may be provided in an arc extinguishing chamber of a switching device, a considerable counterforce is needed to keep the arms of the splitter plates apart.

US 2015090566 A1 discloses an electric switch mounting arrangement including a housing and a stationary contact to be mounted to an aperture in a wall of the housing. The arrangement has a compensation component within the interior area of the aperture for allowing stationary contacts of two different sizes to be mounted to the aperture, which compensation component includes one or more projections formed on the housing or the stationary contact and/or one or more recesses formed on the housing or stationary contact for receiving the one or more projections.

KR 200393296 Y1 discloses a circuit breaker comprising an arc chute having splitter plates and side plates.

SUMMARY

One object of the present disclosure is to provide a splitter plate that has a more reliable operation.

A further object of the present disclosure is to provide a splitter plate that has an improved resistance against deformation by arcs.

A still further object of the present disclosure is to provide a splitter plate that has a reduced tendency of arms bending inwards.

A still further object of the present disclosure is to provide a splitter plate that requires a reduced or eliminated counterforce for holding the arms apart.

A still further object of the present disclosure is to provide a splitter plate that has a simple design.

A still further object of the present disclosure is to provide a splitter plate that solves several or all of the foregoing objects in combination.

A still further object of the present disclosure is to provide an arc extinguishing chamber for a switching device, which arc extinguishing chamber solves one, several or all of the foregoing objects.

A still further object of the present disclosure is to provide a switching device for breaking an electric current, which switching device solves one, several or all of the foregoing objects.

According to one aspect, there is provided a splitter plate for an arc extinguishing chamber in a switching device, the splitter plate comprising a base portion; a pair of arms extending from the base portion; a recess for a movable contact defined between the arms; and a slot in each arm; wherein the recess is arranged between the slots.

Due to the provision of the slots in the arms, the tendency of inward bending of the arms, i.e. towards the recess, can be reduced or eliminated. Blocking of the movable contact can thereby be prevented. The splitter plate according to the present disclosure therefore provides a more reliable operation. In addition, any counterforce for keeping the arms apart can be reduced or eliminated. The recess may be arranged between the slots along an imaginary straight line between the slots.

The slots may be arranged on a respective outside of each arm. As used herein, an outward direction is a direction away from the recess of the splitter plate and an inward direction is a direction towards the recess of the splitter plate. The splitter plate may comprise only two arms.

Each slot may be positioned at 5% to 30%, such as 10% to 20%, such as approximately 15%, of an arm length of the associated arm from the base portion. The slot may thus be positioned "in the beginning" of the arm, i.e. closer to the base portion than to a tip of the arm.

Each slot may have a slot depth of 20% to 80%, such as 40% to 60%, such as approximately 50% of an arm width of the associated arm adjacent to the slot. Alternatively, or in addition, each slot may have a slot width of 0.5 to 3 times, such as 1 to 2 times, a thickness of the splitter plate adjacent to the slot. Furthermore, the slot depth may be 1.5 to 2.5 times the slot width.

The splitter plate may comprise a central axis, e.g. in an extension plane of the splitter plate. The splitter plate may be elongated along the central axis. In this case, the central axis constitutes a longitudinal axis of the splitter plate.

Each slot may extend at an angle of 30 degrees to 150 degrees, such as 60 degrees to 120 degrees, such as substantially perpendicular, or perpendicular (i.e. 90 degrees), to the central axis. Alternatively, or in addition, the recess may extend substantially parallel with, or parallel with, the central axis.

The splitter plate may have a substantially uniform, or uniform, thickness. The splitter plate may for example have a width of ten times the thickness.

The recess may comprise a narrow portion and a wide portion. Thus, a width of the narrow portion (e.g. perpendicular to the central axis) may be smaller than a width of the wide portion (e.g. perpendicular to the central axis). The narrow portion may be positioned between the base portion and the wide portion. That is, the narrow portion may be closest to the base portion.

According to a further aspect, there is provided an arc extinguishing chamber for a switching device, the arc extinguishing chamber comprising a plurality of splitter plates according to the present disclosure.

The splitter plates may be disposed with a distance to each other and may be arranged such that the recess of each splitter plate form a passage for a movable contact of the switching device. The passage may thus be partly enclosed by the arms of the splitter plate. When the movable contact moves in the passage during separation from a stationary contact, the arc is cooled in the passage formed by the recesses of the splitter plates as the arc is stretched out. The arc is split into several smaller arcs that enter between the splitter plates where the arcs are extinguished. The passage formed by the recesses of the splitter plates may for example be straight or curved.

According to a further aspect, there is provided a switching device for breaking an electric current, the switching device comprising a plurality of splitter plates according to the present disclosure or an arc extinguishing chamber according to the present disclosure. The switching device may be a low voltage switching device. A low voltage within the present disclosure may be a voltage of up to 1000 VAC or up to 1500 VDC.

The switching device may for example be constituted by a parallel switching device comprising a main contact arrangement and an arcing contact arrangement in parallel with the main contact arrangement. The main contact arrangement may comprise a stationary main contact and a movable main contact. The arcing contact arrangement may comprise a stationary arcing contact and a movable arcing contact.

In a parallel switching device, the main contacts normally only conduct electric current and are not involved in breaking operations that generate arcs. The material in the main contacts is optimized for high conductivity to reduce the generated power when electric current is flowing. On the other hand, the arcing contacts are arranged to handle the breaking operations and are not intended to continuously conduct electric current. To this end, the arcing contacts may be arranged to separate at a higher speed than the main contacts, for example at twice the speed of the main contacts. A switching device according to the present disclosure is however not limited to a parallel switching device.

The switching device may further comprise a movable contact arranged to move in a passage formed by the recesses of the splitter plates. A width of the passage, through which the movable contact is arranged to move, e.g. a width of a narrow portion of the recess, may be less than twice a width of the movable contact within the recess. Throughout the present disclosure, the movable contact may be constituted by a movable arcing contact.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1:
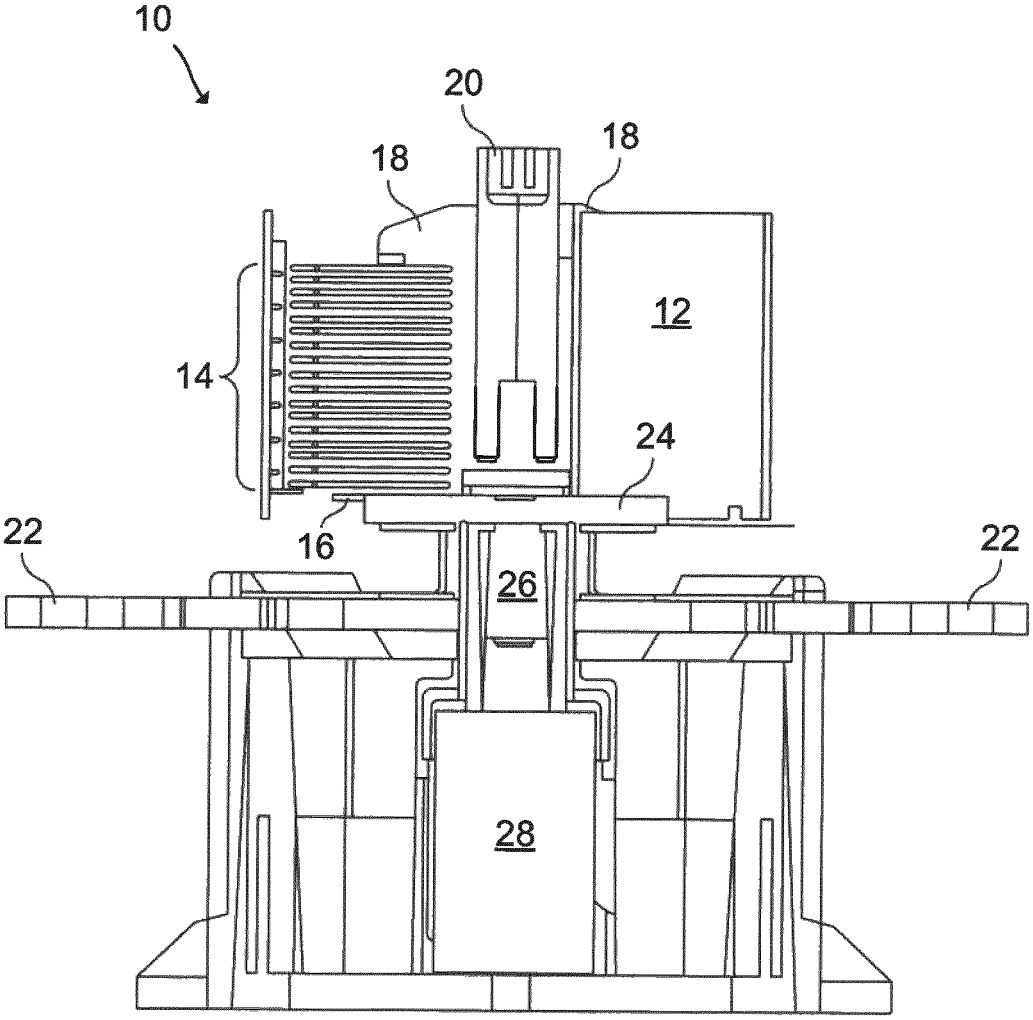
FIG. 1: schematically represents a cross-sectional side view of a switching device comprising a plurality of splitter plates.

In the following, a splitter plate comprising a pair of arms and a slot in each arm, an arc extinguishing chamber for a switching device, which arc extinguishing chamber comprises a plurality of splitter plates, and a switching device for breaking an electric current, which switching device comprises a plurality of splitter plates, will be described. The same reference numerals will be used to denote the same or similar structural features.

FIG. 1 schematically represents a cross-sectional side view of a switching device 10 for breaking an electric current. The switching device 10 may be used for interrupting either a DC current or an AC current, for example of up to 5000 A. The switching device 10 may for example be a contactor, a circuit breaker, or a switch-disconnector.

The switching device 10 comprises an arc extinguishing chamber 12. The arc extinguishing chamber 12 comprises a plurality of splitter plates 14. The arc extinguishing chamber 12 may for example comprise 20 splitter plates 14. The splitter plates 14 are arranged in parallel to each other and with a distance to each other. For example, the splitter plates 14 may be distanced 2 mm from each other. The splitter plates 14 thus form a stack or arc chute assembly. The splitter plates 14 may however be differently oriented. For example, the splitter plates 14 may be angled to each other in a circular sector or fan-shape. The splitter plates 14 may be held in the arc extinguishing chamber 12 by means of plastic (not denoted).

The switching device 10 comprises a stationary contact 16, here constituted by a stationary arcing contact, and a movable contact 18, here constituted by a movable arcing contact. The stationary contact 16 and the movable contact 18 are enclosed within the arc extinguishing chamber 12. The stationary contact 16 is positioned slightly below the lowermost (as seen in FIG. 1) splitter plate 14.

The movable contact 18 is movable relative to the stationary contact 16. To this end, the switching device 10 of this example comprises a contact carrier 20 arranged to move the movable contact 18. When the movable contact 18 has been fully separated from the stationary contact 16, the movable contact 18 may be positioned slightly above the uppermost (as seen in FIG. 1) splitter plate 14. In this way, the arc is split into many smaller arcs. The smaller arcs enter between the splitter plates 14 where the arcs are extinguished. In this way, the arc is cooled.

In the example in FIG. 1, the switching device 10 is a parallel dual switching device, i.e. comprising two arc extinguishing chambers 12. The left-hand side of FIG. 1 shows the stack of splitter plates 14 and the right-hand side of FIG. 1 shows the exterior of the arc extinguishing chamber 12. Although mainly the left-hand side of the switching device 10 will be described, the description also applies to the movable contact 18 within the arc extinguishing chamber 12 on the right-hand side.

The switching device 10 of this example further comprises a stationary main contact 22 and a movable main contact 24. The movable main contact 24 is movable relative to the stationary main contact 22 by means of a main contact carrier 26.

The switching device 10 of this example further comprises an actuating unit 28. The actuating unit 28 is configured to control movements of the contact carrier 20 and the main contact carrier 26 such that the movable contact 18 separates from the stationary contact 16 and the movable main contact 24 separates from the stationary main contact 22. The actuating unit 28 is further configured to control movements of the contact carrier 20 and the main contact carrier 26 such that the movable contact 18 is closed against the stationary contact 16 and the movable main contact 24 is closed against the stationary main contact 22. The actuating unit 28 may comprise a rack and pinion set (not shown) for each of the contact carrier 20 and the main contact carrier 26.

During a breaking operation of the switching device 10, the movable main contact 24 is first slightly separated from the stationary main contact 22. Then, the movable contact 18 is separated from the stationary contact 16. In this way, arcs are generated across the movable contact 18, but not across the movable main contact 24. The separation speed of the movable contact 18 relative to the stationary contact 16 is higher than the separation speed of the movable main contact 24 relative to the stationary main contact 22. Thus, the movable contact 18 moves over a larger separation distance than the movable main contact 24. During a closing operation of the switching device 10, the movable contact 18 is closed against the stationary contact 16 before the movable main contact 24 is closed against the stationary main contact 22.

Figure 2:
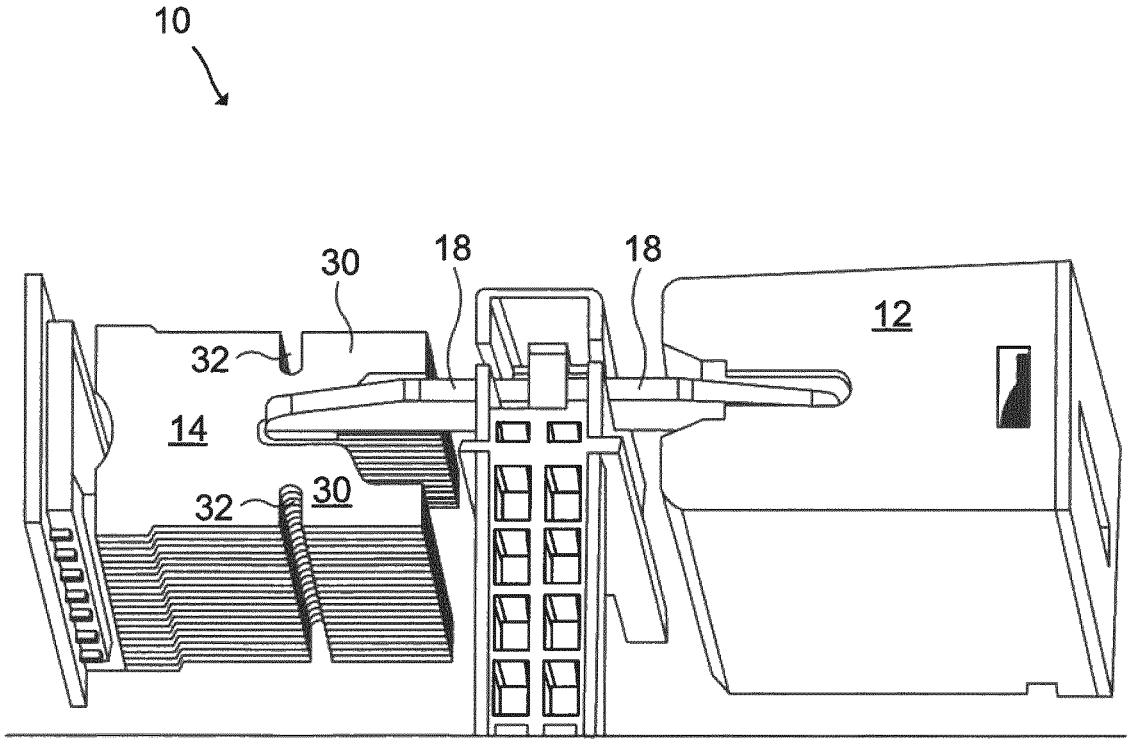
FIG. 2: schematically represents a partial top perspective view of the switching device in FIG. 1.

FIG. 2 schematically represents a partial top perspective view of the switching device 10 in FIG. 1. As shown in FIG. 2, each splitter plate 14 comprises a pair of arms 30. A slot 32 is formed in each of the two arms 30. A recess 34 is defined between the arms 30 of each splitter plate 14.

Figure 3:
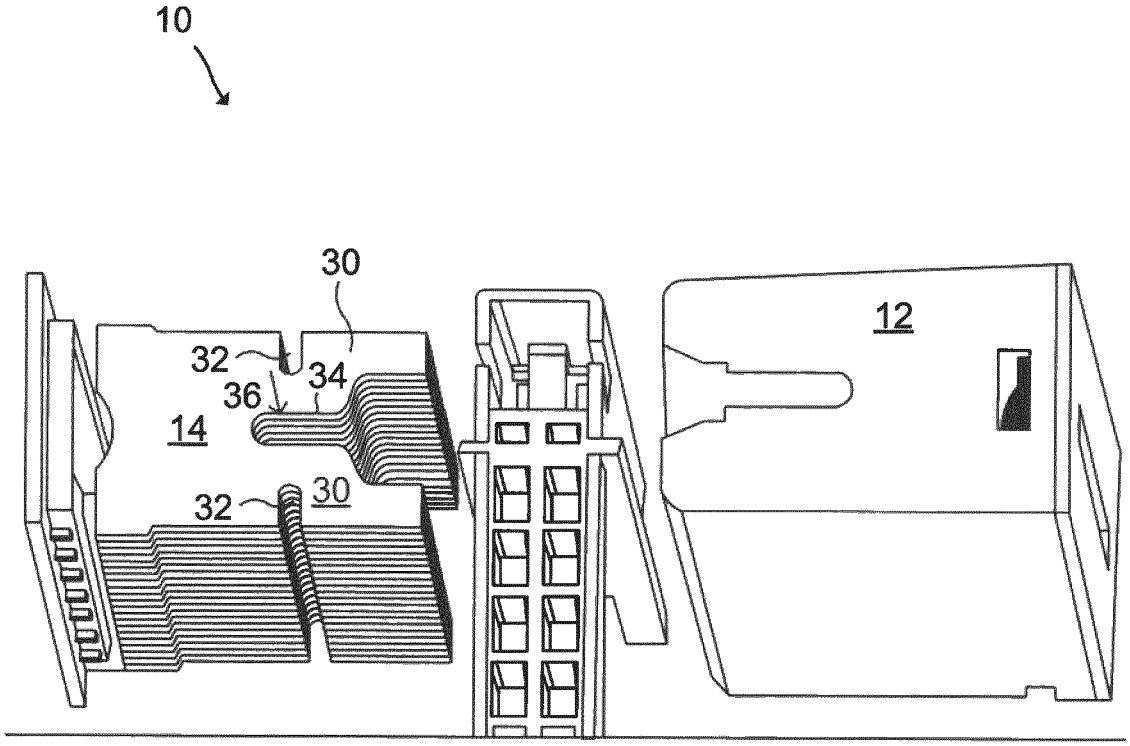
FIG. 3: schematically represents a partial top perspective view of the switching device in FIGS. 1 and 2.

FIG. 3 schematically represents a partial top perspective view of the switching device 10 in FIGS. 1 and 2. The splitter plates 14 are disposed with a distance to each other and are arranged such that the recesses 34 of the splitter plates 14 form a passage 36 for the movable contact 18 (not shown in FIG. 3). The movable contact 18 may move entirely, or almost entirely, within the passage 36, relative to the stationary contact 16.

Figure 4:
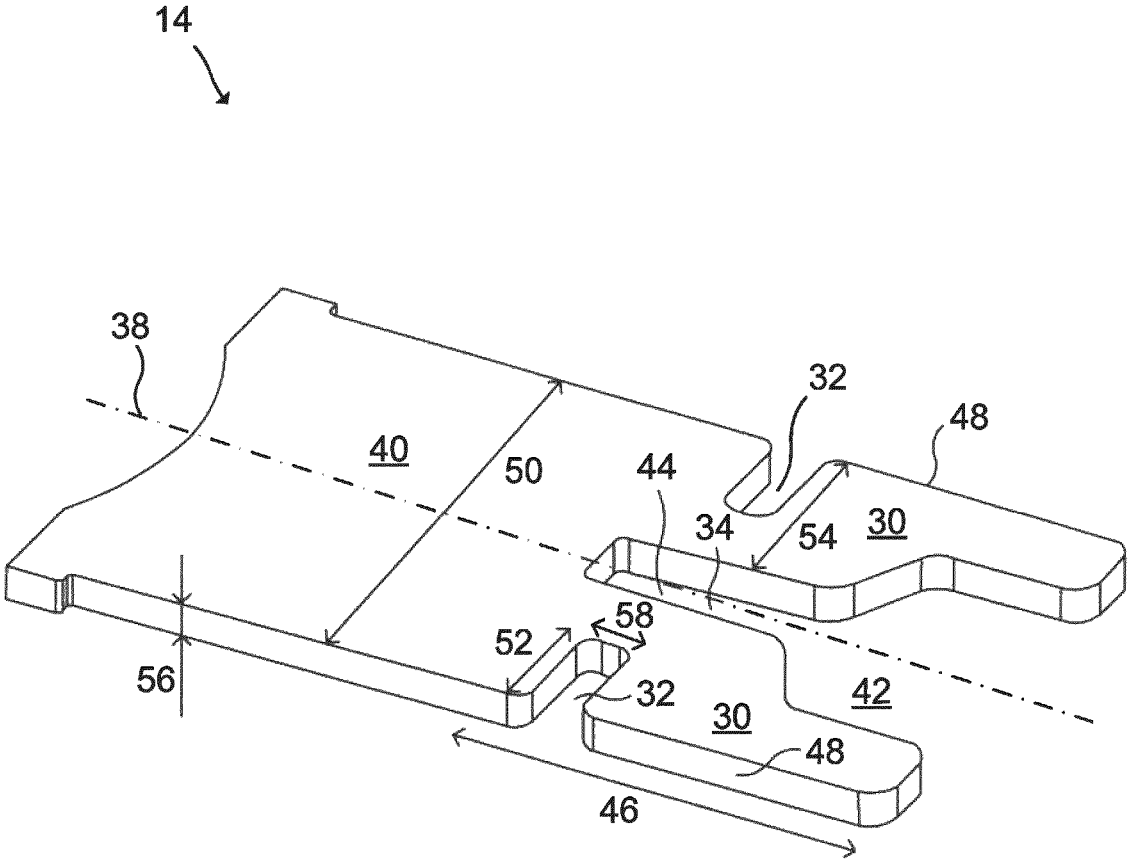
FIG. 4: schematically represents a top perspective view of one of the splitter plates of the switching device in FIGS. 1 to 3.

FIG. 4 schematically represents a top perspective view of one of the splitter plates 14 of the switching device 10 in FIGS. 1 to 3. However, in the example in FIGS. 1 to 3, all splitter plates 14 have the same shape.

The splitter plate 14 of the example in FIG. 4 has a central axis 38. In this example, the splitter plate 14 is elongated such that the central axis 38 also constitutes a longitudinal axis of the splitter plate 14. Furthermore, the splitter plate 14 of this example is symmetric about the central axis 38. The splitter plate 14 may for example be made of one or more conducting materials, such as metal.

The splitter plate 14 comprises a base portion 40. In this example, the base portion 40 is generally rectangular. During a current breaking operation, the arc tends to burn against the base portion 40 of the splitter plate 14. The arc may have a temperature of 5000° C. or higher and thereby heats the splitter plate 14. This heating may cause deformation of the splitter plate 14. Due to the provision of slots 32 in the arms 30 of the splitter plate 14, deformation of the splitter plate 14 during cooling can be reduced. In particular, the slots 32 greatly reduce the tendency of inward bending of the arms 30 during cooling of the arms 30. Thereby, a free passage 36 for the movable contact 18 can be ensured.

Each of the two arms 30 extends from the base portion 40. The recess 34 for the movable contact 18 is defined between the two arms 30.

The recess 34 of the splitter plate 14 in this example comprises a wide portion 42 and a narrow portion 44. The lengths of the wide portion 42 and the narrow portion 44 along the central axis 38 are approximately equal. The narrow portion 44 of the recess 34 extends in parallel with the central axis 38.

The splitter plate 14 is configured such that the recess 34 is arranged between the slots 32. Thus, a slot 32 is positioned on each side of the recess 34 along a width direction of the splitter plate 14 (perpendicular to the central axis 38). That is, the recess 34 extends beyond the slots 32 along the central axis 38. As shown in FIG. 4, each slot 32 is positioned at approximately 15% of an arm length 46 of the arm 30 from the base portion 40. Each slot 32 is positioned at approximately 30% of the length of the narrow portion 44 along the central axis 38.

Each arm 30 comprises an outside 48, i.e. a distal side with respect to the recess 34. The slots 32 are arranged on a respective outside 48 of the arms 30. Each slot 32 extends from an outside 48 of the splitter plate 14 towards the recess 34. In FIG. 4, the base portion 40 has a base portion width 50 that equals a distance between the outsides 48 of the arms 30. Thus, the splitter plate 14 of this specific example has a substantially uniform width.

Furthermore, each slot 32 has a slot depth 52. The slot depth 52 is thus the length of the slot 32 from the outside 48 of the associated arm 30 towards the recess 34. The slot depth 52 of each slot 32 is approximately 50% of an arm width 54 of the associated arm 30 adjacent to the slot 32, i.e. of an arm width 54 aligned with the narrow portion 44 of the recess 34.

FIG. 4 further denotes a thickness 56 of the splitter plate 14. The splitter plate 14 of this example has a uniform thickness 56. Each slot 32 has a slot width 58 of approximately 1.5 times the thickness 56 of the splitter plate 14.

While the present disclosure has been described with reference to exemplary embodiments, it will be appreciated that the present invention is not limited to what has been described above. For example, it will be appreciated that the dimensions of the parts may be varied as needed.

The invention claimed is:

1. A splitter plate for an arc extinguishing chamber in a switching device, the splitter plate comprising:

a base portion;

a pair of arms extending from the base portion;

a recess for a movable contact defined between the arms; and a slot in each arm, the slots being arranged on a respective outside of each arm;

wherein the recess is arranged between the slots; and wherein each slot has a slot depth of 40% to 60% of an arm width of the arm adjacent to the slot.

2. The splitter plate according to claim 1, wherein each slot is positioned at 5% to 30% of an arm length of the arm from the base portion.

3. The splitter plate according to claim 2, wherein each slot is positioned at 10% to 20% of the arm length of the arm from the base portion.

4. The splitter plate according to claim 3, wherein each slot is positioned at approximately 15% of the arm length of the arm from the base portion.

5. The splitter plate according to claim 1, wherein each slot has a slot width of 0.5 to 3 times a thickness of the splitter plate adjacent to the slot.

6. The splitter plate according to claim 5, wherein the slot width of each slot is 1 to 2 times the thickness of the splitter plate adjacent to the slot.

7. The splitter plate according to claim 1, wherein the splitter plate comprises a central axis.

8. The splitter plate according to claim 7, wherein the splitter plate is elongated along the central axis.

9. The splitter plate according to claim 8, wherein the recess extends substantially parallel with the central axis.

10. The splitter plate according to claim 7, wherein each slot extends at an angle of 30 degrees to 150 degrees relative to the central axis.

11. The splitter plate according to claim 10, wherein each slot extends at an angle of 60 degrees to 120 degrees relative to the central axis.

12. The splitter plate according to claim 11, wherein each slot extends substantially perpendicular to the central axis.

13. The splitter plate according to claim 1, wherein the splitter plate has a substantially uniform thickness.

14. The splitter plate according to claim 1, wherein the recess comprises a narrow portion and a wide portion.

15. The splitter plate according to claim 1, wherein the slot depth of each slot is approximately 50% of the arm width of the arm adjacent to the slot.

16. An arc extinguishing chamber for a switching device, the arc extinguishing chamber comprising a plurality of splitter plates each including:

a base portion;

a pair of arms extending from the base portion;

a recess for a movable contact defined between the arms; and a slot in each arm, the slots being arranged on a respective outside of each arm;

wherein the recess is arranged between the slots; and wherein each slot has a slot depth of 40% to 60% of an arm width of the arm adjacent to the slot.

17. The arc extinguishing chamber according to claim 16, wherein the splitter plates are disposed with a distance from each other and are arranged such that the recess of each splitter plate form a passage for the movable contact of the switching device.

18. A switching device for breaking an electric current, the switching device comprising a plurality of splitter plates each including:

a base portion;

a pair of arms extending from the base portion;

a recess for a movable contact defined between the arms; and a slot in each arm, the slots being arranged on a respective outside of each arm;

wherein the recess is arranged between the slots; and wherein each slot has a slot depth of 40% to 60% of an arm width of the arm adjacent to the slot.

19. The switching device according to claim 18, further comprising the movable contact arranged to move in a passage formed by the recesses of the splitter plates.

20. The switching device according to claim 18, wherein at least one of said plurality of splitter plates is provided as an arc extinguishing chamber.

* * * * *